US006431668B1

(12) United States Patent
Reddicliffe

(10) Patent No.: US 6,431,668 B1
(45) Date of Patent: Aug. 13, 2002

(54) METHOD OF INSTALLING A TELESCOPIC SHELF IN A CABINET

(76) Inventor: Edward Arnold Reddicliffe, Coxhill, Boldre, Lymington, Hants S041 8PS (GB)

( * ) Notice: Subject to any disclaimer, the term of this patent is extended or adjusted under 35 U.S.C. 154(b) by 0 days.

(21) Appl. No.: 09/622,266

(22) PCT Filed: Jan. 22, 1999

(86) PCT No.: PCT/GB99/00226

§ 371 (c)(1),
(2), (4) Date: Aug. 14, 2000

(87) PCT Pub. No.: WO99/42020

PCT Pub. Date: Aug. 26, 1999

(30) Foreign Application Priority Data

Feb. 19, 1998 (GB) ..... 9803527

(51) Int. Cl.[7] ..... A47B 88/00
(52) U.S. Cl. ..... 312/334.5; 312/334.1
(58) Field of Search ..... 312/334.1, 334.4, 312/334.5, 334.7, 334.8, 330.1, 350; 211/189, 26

(56) References Cited

U.S. PATENT DOCUMENTS 3,110,536 A 11/1963 Constantini et al. ..... 312/350
3,133,768 A * 5/1964 Klakovich ..... 312/334.8 X
4,440,455 A 4/1984 Lanting et al.
5,470,144 A * 11/1995 Wen ..... 312/330.1 X
5,779,333 A 7/1998 Lautenschlager ..... 312/334.15
5,833,337 A * 11/1998 Kofstad ..... 312/334.5
5,941,621 A * 8/1999 Boulay et al. ..... 312/334.5 X

FOREIGN PATENT DOCUMENTS

DE 296 13 357 1/1998

OTHER PUBLICATIONS

International Search Report dated Jun. 21, 1999, PCT/GB99/00226.

* cited by examiner

*Primary Examiner*—James O. Hansen
(74) *Attorney, Agent, or Firm*—Baker & Daniels

(57) ABSTRACT

A method of installing a telescopic shelf in a cabinet comprises installing a pair of facing guides, each guide having first and second brackets fixed at opposed ends of the guide and each bracket having either a planar lug or a hook for engaging with a series of mounting holes. When the guides have been installed, a telescopic shelf can be slid into the facing channels. As the brackets are fixed to the guide and, the fixing of the guides within the cabinet is carried out purely by engagement of parts of the brackets with the mounting post, there is never any need for loose pieces to be used within the cabinet. The brackets are telescopically adjustable to accommodate guides and shelves of different dimensions.

19 Claims, 4 Drawing Sheets

METHOD OF INSTALLING A TELESCOPIC SHELF IN A CABINET

BACKGROUND OF THE INVENTION

1. Field of the Invention

The present invention relates to a method of assembling a cabinet, particularly the type of cabinet having at least one telescopic shelf.

2. Description of the Related Art

In certain types of cabinet with telescopic shelves, the guides for the telescopic shelves are fixed to the cabinet by brackets having a pair of vertically spaced lugs which diverge in a vertical direction. In this case, a respective bracket is provided at each end of the guide and each bracket is fixed in place by inserting one or other of the lugs into a mounting hole and then forcing the other lug so that it fits into a vertically spaced mounting hole, whereupon the two lugs hold the guide securely in place.

Such an arrangement is not suitable for use with electronic equipment, as when the shelves are extended telescopically from the cabinet, the bending moment on the rearmost brackets is considerably exaggerated, so that the vertical force acting on the rearmost bracket tends to cause this bracket to pop out of engagement with the mounting holes.

Therefore, for such applications, it is necessary to bolt each bracket in place to ensure that it remains engaged with the mounting post. Such an arrangement has a disadvantage that each bracket has several loose pieces which can easily be dropped inside the cabinet, and also in that the brackets are time consuming to install which is particularly a problem in installations which require numerous cabinets, each of which has numerous telescopic shelves.

U.S. Pat. No. 3,110,536 discloses a method of installing a telescopic shelf in a cabinet comprising an opening at one side and being substantially rectangular in plan, a pair of rear mounting posts extending vertically in the two corners of the cabinet remote from the open side, and a pair of front mounting posts extending vertically in the corners of the cabinet adjacent to the opening, mounting holes being provided in each pair of mounting posts, the method comprising the steps of installing a guide into the cabinet, the guide comprising a longitudinally extending channel portion for receiving a respective edge of the telescopic shelf, a first bracket fixed at the rear end of the guide and a second bracket fixed at the front end of the guide, the first bracket being provided with a first lug, the second bracket having a second lug; the steps of installing the guide comprising fitting the first lug in a mounting hole in a rear mounting post and moving the guide longitudinally until the first lug is secured in the mounting hole, and twisting the guide about a longitudinal extending axis, so as to insert the second lug into a mounting hole in the front mounting post, the engagement of the second bracket with the front mounting post preventing movement of the guide longitudinally sufficient to release the first bracket from the rear mounting post; installing a second guide in a similar manner so that its channel portion faces the channel portion of the first guide; and sliding the opposite edges of a telescopic shelf into the facing channels.

With this arrangement, when the shelf is extended and loaded vertically thereby transmitting an upward vertical load to the first bracket, the first bracket cannot be disengaged from the rear mounting post as to disengage the hook from the mounting hole requires movement of the guide longitudinally in the horizontal direction, which is prevented by the second bracket. As the brackets are fixed to the guide and, the fixing of the guides within the cabinet is carried out purely by engagement of parts of the brackets, with the mounting posts, there is never any need for loose pieces to be used within the cabinet.

In practice, it has been found that, with this arrangement, the telescopic shelves can be installed 95% quicker than with guides which must be bolted in place. This represents a enormous time saving for installations where numerous cabinets are used. It also allows unskilled operators to install shelves without tools, allowing an operator to adjust the position of the shelves without difficulty. Access for the installation is only required from the front, so that there is no need to remove the side panels of the cabinet.

There is a growing need within electronic cabinets to mount equipment of various "mounting standards" and of various front to back (depth) dimensions. Some of this equipment requires that the front mounting posts and the rear mounting posts are set at depths which are specific to that equipment. In some cases, these centres will not match the fixing centres of side rails or telescopic slides. In such cases, extra pairs of vertical mounting posts are required to accommodate these various depth requirements. In densely populated cabinets, it is often impossible to fit these mounting posts.

BRIEF SUMMARY OF THE INVENTION

According to the present invention, the method disclosed in U.S. Pat. No. 3,110,536 is characterised in that at least one of the brackets for each guide is telescopically adjusted to set the position of the guide relatively to at least one of the mounting posts in the depth and/or width directions of the cabinet.

This arrangement enables great versatility in mounting the shelf guides at appropriate positions in the cabinet to meet operational requirements. For example, short guides can be fitted in deep cabinets by using the brackets to bridge the difference in depth.

The range of application is therefore dramatically greater than fixed centre versions of this type of quick fit assembly, and is a unique, and cost effective solution, for populating a densely packed cabinet with equipment of widely varying depth or width measurements, whilst preserving the quick fit characteristics of the design.

For depth adjustment, at least one of the brackets may be telescopically adjustable relatively to the guide in the longitudinal direction of the guide. For width adjustment, both brackets will need to be adjustable and two parts of each bracket may be telescopically adjustable relatively to one another in the width direction of the cabinet.

The present invention also includes a cabinet comprising an opening at one side and being substantially rectangular in plan; a pair of rear mounting posts extending vertically in the two corners of the cabinet remote from the open side; a pair of front mounting posts extending vertically in the corners of the cabinet adjacent to the opening; mounting holes provided in each pair of mounting posts; a pair of guides being mounted at opposite sides of the cabinet and having facing channel portions between which the telescopic shelf is slidably received; each guide being attached within the cabinet by a first bracket fixed at the rear end of the guide and a second bracket fixed at the front end of the guide, the first bracket having a first lug mounted in a mounting hole such that it must be moved by a certain amount in the longitudinal direction of the guide to be disengaged from its mounting hole, the second bracket having a downwardly inclined second lug fitted in a mounting hole, and engaging with the lowermost edge of a mounting hole, the engagement of the second lug with its mounting hole being such as to prevent the movement of the first lug by the certain amount; and a telescopic shelf slidably supported between the facing channel portions; characterised in that at least one of the brackets for each guide is telescopically adjustable to set the position of the guide relatively to at least one of the mounting posts in the depth and/or width directions of the cabinet.

If the first lug is planar and extends rearwardly from the first bracket, the lug is engaged by movement of the guide in the direction in which the shelf is retracted. On the other hand, if the first lug is a hook, the open portion of which faces the front of the guide, the hook is engaged by being fitted into a mounting hole in a horizontal direction and pulled forwardly so that the bottom of the hook abuts against a vertically extending edge of the mounting hole. This second approach has been found to provide a more rigid support for the guide. Further, the hooks can be fitted into mounting holes which face across the cabinet, rather than mounting holes which face the front of the cabinet. This is advantageous with cabinets for electronic equipment in which the front facing mounting holes are conventionally used for mounting other equipment.

In order to provide a more rigid connection the first bracket preferably has two or more elevationally spaced first lugs. Although some vertical movement of the first bracket can be tolerated, another way of improving the rigidity of the brackets is for the height of the or each first lug to be substantially equal to the height of the mounting hole in which the or each first lug is fitted. This prevents movement of the first bracket in a vertical direction. Furthermore, a pair of vertically spaced second lugs may be provided and which diverge in the vertical direction, such that the uppermost lug engages with the top edge of a mounting hole. The width of the or each second lug is preferably substantially equal to the width of the mounting hole in which respective lug is engaged, to prevent movement of the second bracket in the direction in which the shelf is retracted and extended.

As the load on the second bracket is almost exclusively a downward vertical load, it is preferable for the uppermost lug to extend vertically by a greater extent than the lowermost lug to prevent the first bracket from being dislodged by a vertically downward load. When such a bracket is installed the longer uppermost lug is firstly inserted into a mounting hole and the guide is lifted slightly in order to force the second lug into its mounting hole.

BRIEF DESCRIPTION OF THE SEVERAL VIEWS OF THE DRAWINGS

Examples of cabinets constructed in accordance with the present invention will now be described with reference to the accompanying drawings, in which.

DETAILED DESCRIPTION OF THE INVENTION

Figure 1:
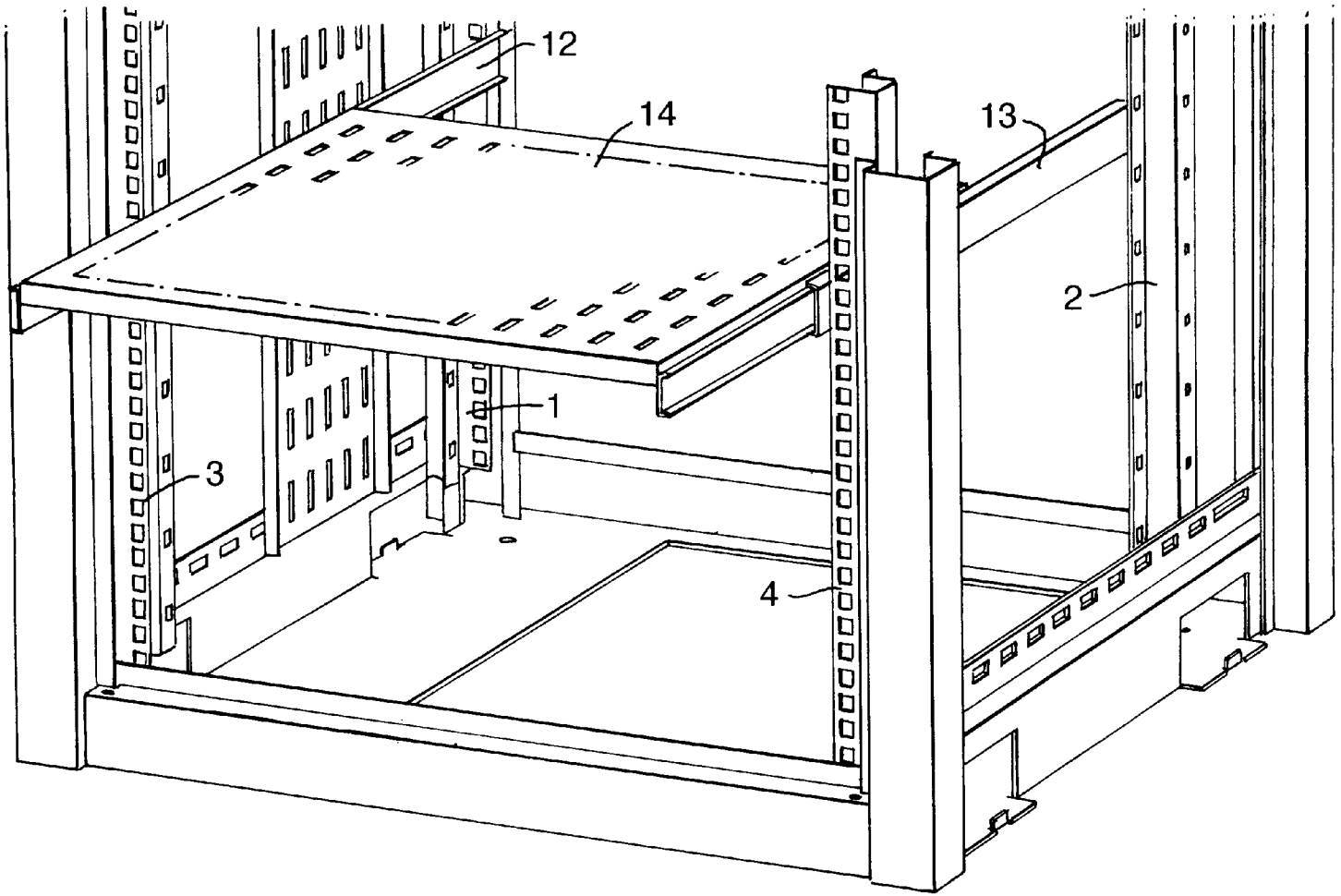
FIG. 1 is a schematic front perspective view showing the inside of a cabinet and in particular the mounting of one telescopic shelf.
Figure 2:
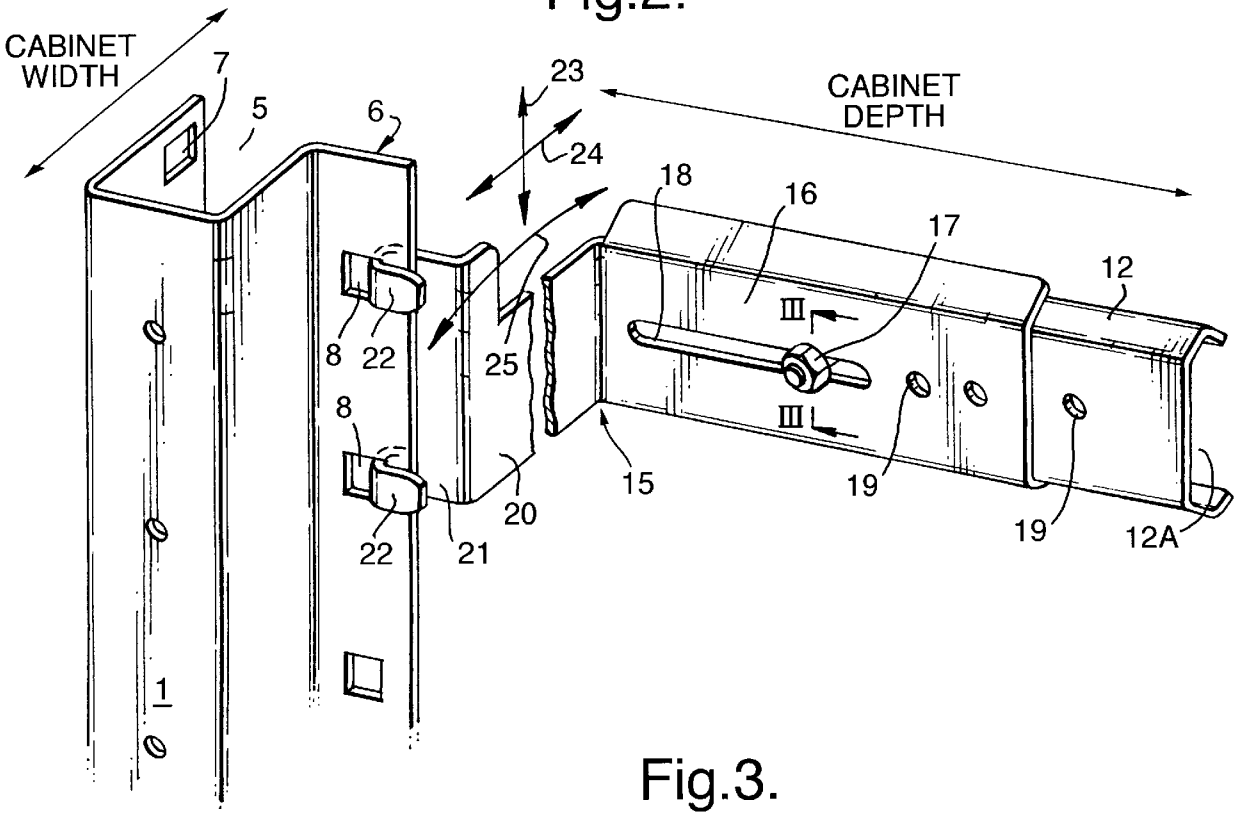
FIG. 2 is a schematic perspective view of a first example of a first bracket.
Figure 6:
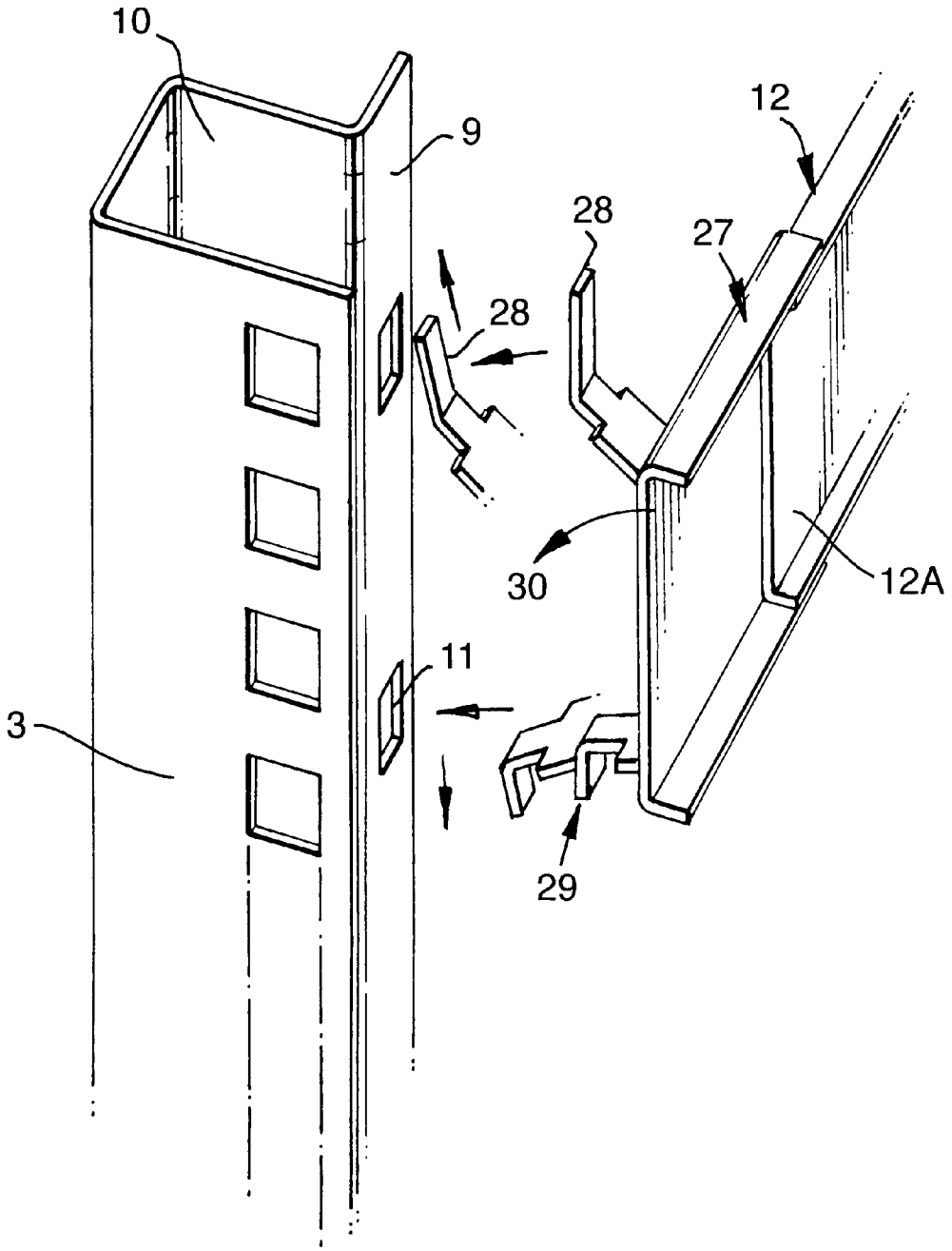

As shown in FIG. 1 the cabinet is substantially rectangular and has an open front which may be closed by one or more doors. In the rear corners of the cabinet are a pair of vertically extending rear mounting posts 1, 2, while at the front corners are a pair of vertically extending front mounting posts 3, 4. As best shown in FIG. 2 the rear mounting posts 1, 2 have a channel portion 5 facing across the cabinet and a forwardly extending flange 6 extending from the forward edge of the channel portion 5. At the rear of the channel portion 5 are a plurality of vertically arranged forwardly facing first mounting holes 7 which are used for mounting ancillary electronic equipment. A plurality of second mounting holes 8 are vertically arranged along the flange 6 and face across the cabinet. The forward mounting posts 3, 4 are of the same construction as the rear mounting posts 1, 2 but face in the opposite direction as best shown in FIG. 6. In this case, a flange 9 extends rearwardly from a channel portion 10 and is provided with a plurality of vertically spaced third mounting holes 11.

FIG. 1 illustrates a pair of guides 12, 13 mounted on opposite sides of the cabinet and having inwardly facing longitudinally extending channels 12A,13A which support a shelf 14. The shelf 14 is telescopic in that it can be pulled out to an extended position through the front of the cabinet. The shelf is illustrated in a partially extended position in FIG. 1. The structure of the telescopic shelf is conventional and is unimportant to the present invention which is concerned only with the manner of supporting the guides 12, 13. The telescopic shelf could, for example, have conventional intermediate guide portions between the guides 12, 13 and the edges of the shelf. only one shelf is shown in FIG. 1. However, in practice, a number of these shelves will generally be used in each cabinet.

Figure 3:
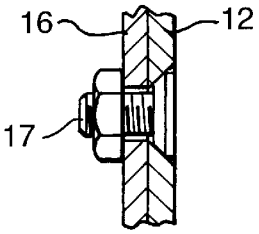
FIG. 3 is a section taken on the line III—III in FIG. 2.

A first embodiment of a first bracket 15 will now be described with reference to FIG. 2. The first bracket 15 has a main portion 16, which is channel shaped and embraces, and is telescopically adjustable along, the guide 12. The adjusted position is fixed by a nut and bolt 17, which has a counter sunk head received in a recess in the base of the channel of the guide, as shown in FIG. 3. The bolt is selectively passed through aligned slots 18 or holes 19 in the two parts to provide infinitely variable or preset adjustment to accommodate different lengths of guide to the spacing at the front and rear mounting posts. A cranked web portion 20 connects the main portion to a rearwardly extending flange 21 and acts to offset the guide 12 from the mounting post in the width direction of the cabinet. This lateral offset may be made adjustable by the modification shown in FIG. 4 where the cranked web portion 20 of the bracket 15A is replaced by two telescopic portions: a channel portion 20A, which embraces a planar portion 20B. These two portions are relatively fixed, after adjustment, by a bolt 17 passing through slots 18 and/or holes 19 as in FIG. 2. The adjustable lateral offset may be used with or without the adjustable longitudinal offset.

A pair of vertically spaced hooks 22 extend from the rearwardly extending flange 21. The hooks turn through an angle of substantially 180° so that the ends of the hook are in a plane substantially parallel to the plane of the rearwardly extending flange 21. The hooks 22 engage with respective second mounting holes 8, and each hook has a height substantially equal of the height of the mounting hole 8. This relationship between the height of the hooks 22 and mounting holes 8 resists movement in the vertical direction 23, the engagement of the inner surfaces of the hook with the flange 6 prevents movement in the horizontal direction 24 while the presence of two hooks prevents twisting under torsion in the direction shown by arrow 25.

Figure 5:
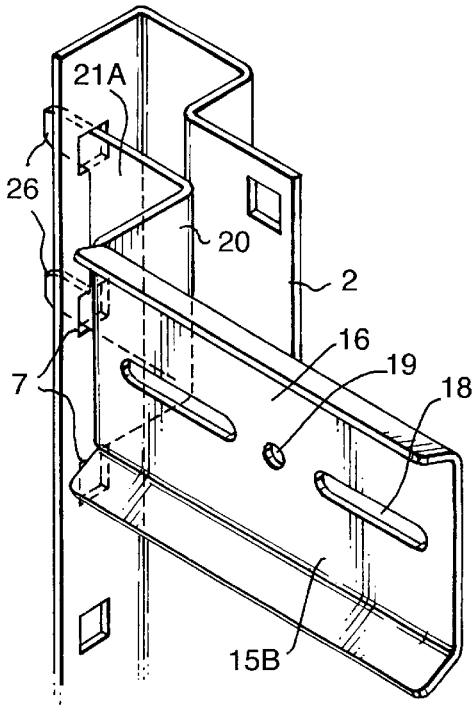
FIG. 5 is a schematic perspective view showing a second modification of the first bracket mounted to a post which faces the post shown in FIG. 2; and, FIG. 6 is a schematic perspective view of a second bracket.

Another modification of a first bracket 15B is shown in FIG. 5. In this case, instead of the hooks 22, the first bracket is provided with a pair of lugs 26 which are coplanar and integral with the rearwardly extending flange 21A. These lugs 26 engage with the first mounting holes 7 in the rear of the channel portion 5. The height of each lug 26 is substantially equal to the height of each first mounting hole 7 to prevent movement in the vertical direction 23. Again, it is apparent that engagement between the two lugs 26 and first mounting holes 7 will prevent movement in the horizontal direction 24, and twisting in the direction of arrow 25.

Details of the second bracket 27 are as shown in FIG. 6. The second bracket 26 is fastened to the front end of the guide 12. Extending from the second bracket 27 in the opposite direction to the direction in which the channel of the guide 12 opens are an upper lug 28 and a lower lug 29. The lugs 28, 29 diverge in a vertical direction with the vertical extent of the upper lug 28 being greater than that of the lower lug 29.

In order to install a guide into the cabinet the guide 12, 13 with first 15 and second 27 brackets to respective ends is introduced into the cabinet. If the first bracket is as illustrated in FIG. 2, the hooks 22 are introduced into mounting holes 8 at the desired height and the guide is pulled slightly forwardly so that the bottoms of the hooks engage with the front vertical edges of the mounting holes 8. Alternatively, if the first bracket is as shown in FIG. 5 the lugs 26 are inserted into the mounting holes 7 at the desired height until the rear edge of the rearwardly extending flange 21A abuts against the back of the channel portion 5.

The front end of the guide is then twisted in the direction of arrow 30 shown in FIG. 6 so that the upper lug 28 is tilted forwardly into the position shown by the detached portion of the illustration of FIG. 6, and is then inserted into the appropriate third mounting hole 11. The twisting action is then released allowing the lower lug 29 to be inserted through a lower mounting hole 11. A slight downward movement finally locates the second bracket 27 in place.

Figure 4:
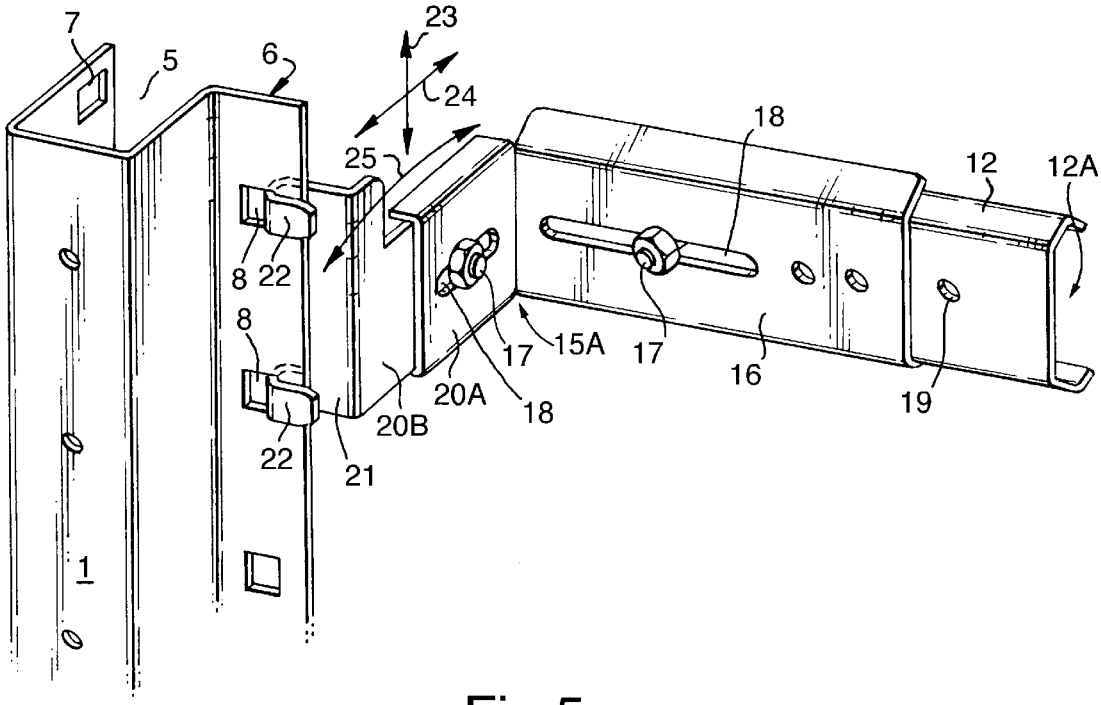
FIG. 4 is a view similar to FIG. 2, but showing a modification of the first bracket.

When the shelf guides are to be adjustable towards or away from one another in the width direction of the cabinet, the second brackets 27 will also include a cranked portion 20 with telescopically adjustable parts 20A,20B as shown in FIG. 4.

An alternative configuration which is contemplated is one in which a plurality of elevationally spaced parallel guides are fixed between each pair of first and second brackets, so that installing one pair of these brackets provides a plurality of guides.

What is claimed is:

1. A method of installing a telescopic shelf in a cabinet comprising an opening at one side and being substantially rectangular in plan, a pair of rear mounting posts extending vertically in two rear corners of the cabinet remote from the opening, and a pair of front mounting posts extending vertically in two front corners of the cabinet adjacent to the opening, mounting holes being provided in each pair of mounting posts, the method comprising the steps of installing a guide into the cabinet, the guide comprising a longitudinally extending channel portion for receiving a respective edge of the telescopic shelf, a first bracket fixed at the rear end of the guide and a second bracket fixed at the front end of the guide, the first bracket being provided with a first lug, the second bracket having a second lug; the steps of installing the guide comprising fitting the first lug in a mounting hole in one of the rear mounting posts and moving the guide longitudinally until the first lug is secured in the mounting hole, and twisting the guide about a longitudinal extending axis, so as to insert the second lug into a mounting hole in the front mounting post, and the engagement of the second bracket with the front mounting post preventing movement of the guide longitudinally sufficient to release the first bracket from the rear mounting post; installing a second guide in a similar manner so that its channel portion faces the channel portion of the first guide; and sliding the opposite edges of a telescopic shelf into the facing channels; wherein at least one of the brackets for each guide is telescopically adjusted to set the position of the guide relatively to at least one of the mounting posts in at least one of the depth and width directions of the cabinet.

2. A method according to claim 1, wherein at least one of the brackets is telescopically adjustable relatively to the guide in the longitudinal direction of the guide.

3. A method according to claim 1, wherein two parts of each bracket are telescopically adjustable relatively to one another in the width direction of the cabinet.

4. A method according to claim 1, wherein the telescopically adjusted bracket is fixed against further adjustment by means of a fixing member passing through a hole to provide a preset adjustment.

5. A method according to claim 1, wherein the telescopically adjusted bracket is fixed against further adjustment by means of a fixing member passing through a slot to provide an infinitely variable adjustment.

6. A method according to claim 1, wherein the first lug is planar and extends rearwardly from the first bracket.

7. A method according to claim 1, wherein the first lug is a hook, an open portion of which faces the front of the guide.

8. A method according to claim 1, wherein at least one of the brackets for each guide is telescopically adjusted relative to at least one of the mounting posts in both the depth and the width directions of the cabinet.

9. A cabinet comprising an opening at one side and being substantially rectangular in plan; a pair of rear mounting posts extending vertically in two rear corners of the cabinet remote from the opening; a pair of front mounting posts extending vertically in two front corners of the cabinet adjacent to the opening; mounting holes provided in each pair of mounting posts; a pair of guides being mounted at opposite sides of the cabinet and having facing channel portions between which the telescopic shelf is slidably received; each guide being attached within the cabinet by a first bracket fixed at the rear end of the guide and a second bracket fixed at the front end of the guide, the first bracket having a first lug mounted in a mounting hole such that it must be moved by a certain amount in the longitudinal direction of the guide to be disengaged from its mounting hole, the second bracket having a downwardly inclined second lug fitted in a mounting hole, and engaging with the lowermost edge of the mounting hole, the engagement of the second lug with its mounting hole being such as to prevent the movement of the first lug by the certain amount; and a telescopic shelf slidably supported between the facing channel portions; wherein at least one of the brackets for each guide is telescopically adjustable to set the position of the guide relatively to at least one of the mounting posts in at least one of the depth and width directions of the cabinet.

10. A cabinet according to claim 9, wherein at least one of the brackets is telescopically adjustable relatively to the guide in the longitudinal direction of the guide.

11. A cabinet according to claim 9, wherein two parts of each bracket are telescopically adjustable relatively to one another in the width direction of the cabinet.

12. A cabinet according to claim 9, wherein the telescopically adjusted bracket is fixed against further adjustment by means of a fixing member passing through a hole to provide a preset adjustment.

13. A cabinet according to claim 9, wherein the telescopically adjusted bracket is fixed against further adjustment by means of a fixing member passing through a slot to provide an infinitely variable adjustment.

14. A cabinet according to claim 9, wherein the first bracket has two or more elevationally spaced first lugs.

15. A cabinet according to claim 9, wherein the height of the or each first lug is substantially equal to the height of the mounting hole in which the or each first lug is fitted.

16. A cabinet according to claim 9, further comprising a pair of vertically spaced second lugs which diverge in the vertical direction, such that the uppermost lug engages with the top edge of a mounting hole.

17. A cabinet according to claim 9, herein the or each first lug is a planar lug projecting rearwardly from the first bracket and fitted into a forwardly facing mounting hole in the mounting post.

18. A cabinet according to claim 9, wherein the or each first lug is a hook, an open portion of which faces the front of the guide with the bottom of the hook abutting against a vertically extending front edge of a mounting hole.

19. A cabinet according to claim 9, wherein at least one of the brackets for each guide is telescopically adjustable relative to at least one of the mounting posts in both the depth and the width directions of the cabinet.

* * * * *